US006345755B1

(12) United States Patent
Fields

(10) Patent No.: US 6,345,755 B1
(45) Date of Patent: Feb. 12, 2002

(54) NAIL DRIVING DEVICE WITH DEPTH GUIDE

(76) Inventor: Thomas Leslie Fields, 2018 County Rd. 68, Fayette, AL (US) 35555

( * ) Notice: Subject to any disclaimer, the term of this patent is extended or adjusted under 35 U.S.C. 154(b) by 0 days.

(21) Appl. No.: 09/452,645

(22) Filed: Dec. 1, 1999

Related U.S. Application Data

(60) Provisional application No. 60/113,379, filed on Dec. 23, 1998.

(51) Int. Cl.[7] ..... B25C 1/02

(52) U.S. Cl. ..... 227/142; 227/119; 227/147; 227/156

(58) Field of Search ..... 227/147, 119, 227/142, 156

(56) References Cited

U.S. PATENT DOCUMENTS 1,604,675 A * 10/1926 Bernard ..... 227/147
2,588,738 A * 3/1952 Lundgren ..... 227/147
2,643,379 A * 6/1953 Matovich ..... 227/147
2,866,974 A * 1/1959 Hoffman ..... 227/147
4,179,058 A * 12/1979 Yost ..... 227/147
4,733,812 A * 3/1988 Lewis et al. ..... 227/147
4,978,047 A * 12/1990 Chen ..... 227/147
5,529,234 A * 6/1996 Juneau ..... 227/147
5,961,024 A * 10/1999 Wright, Jr. ..... 227/147
6,036,073 A * 3/2000 Newhouse ..... 227/147

* cited by examiner

*Primary Examiner*—Scott A. Smith
(74) *Attorney, Agent, or Firm*—Goldstein Law Offices, P.C.

(57) ABSTRACT

A nail driving device with depth guide including an outer cylindrical tube. A tip portion is secured within an open lower end of the outer cylindrical tube. The tip portion has a longitudinal central channel therethrough. The central channel has an open upper end in communication with a hollow interior of the outer cylindrical tube. The central channel receives a nail therein. An inner cylindrical tube is slidably received within the open upper end of the outer cylindrical tube. The inner tube has measurement markings disposed thereon. A plunger portion is secured to s closed lower end of the inner cylindrical tube. The plunger portion includes a stem portion dimensioned for being received within the open upper end of the channel for contacting a head of a nail positioned therein.

7 Claims, 2 Drawing Sheets

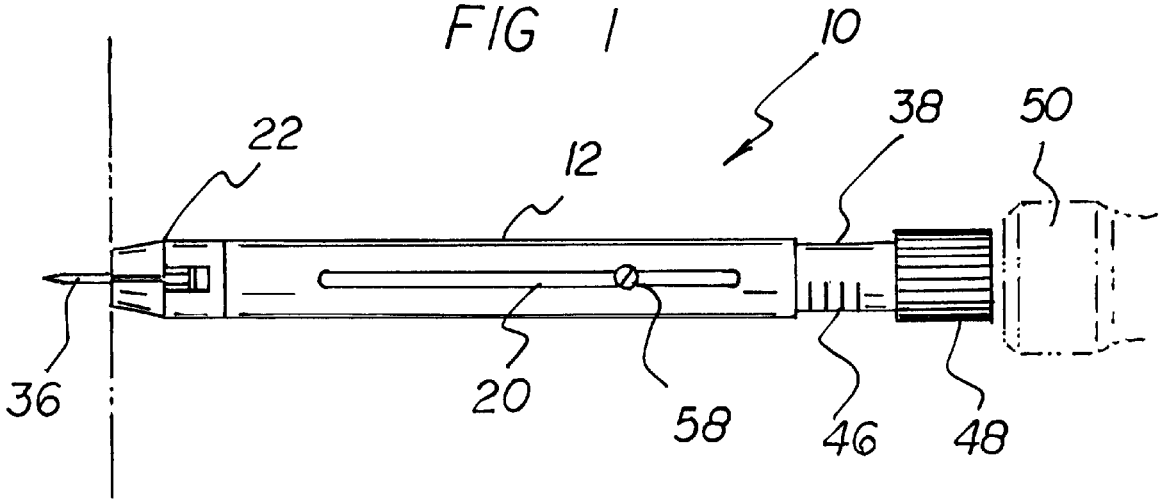
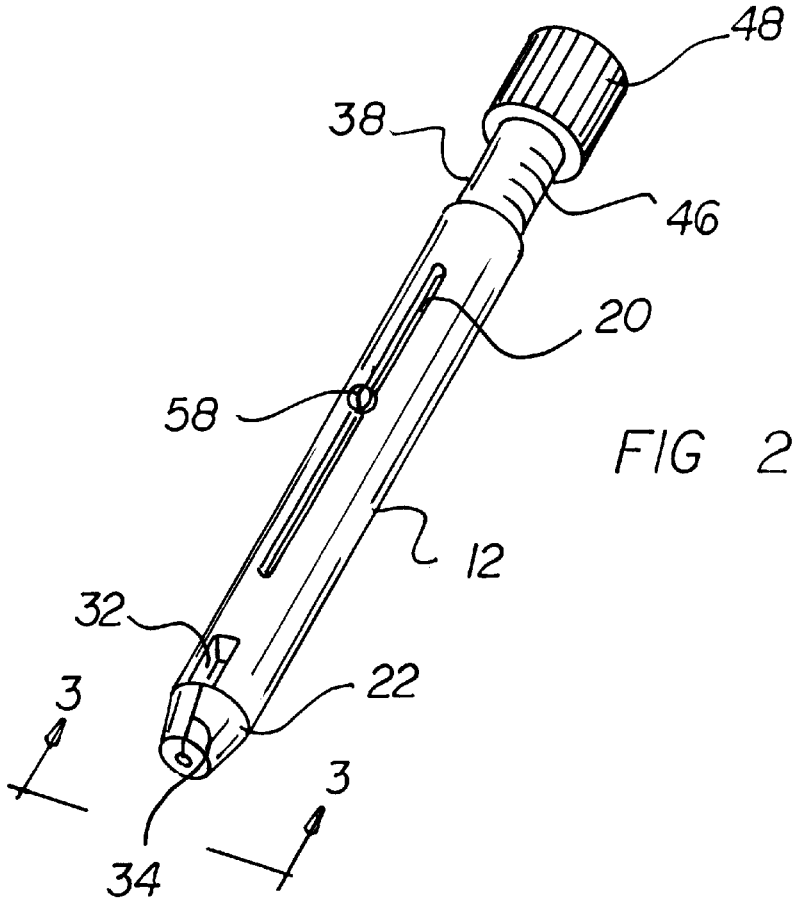
FIG 2

FIG 3
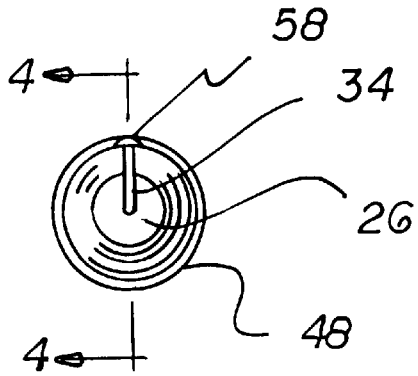
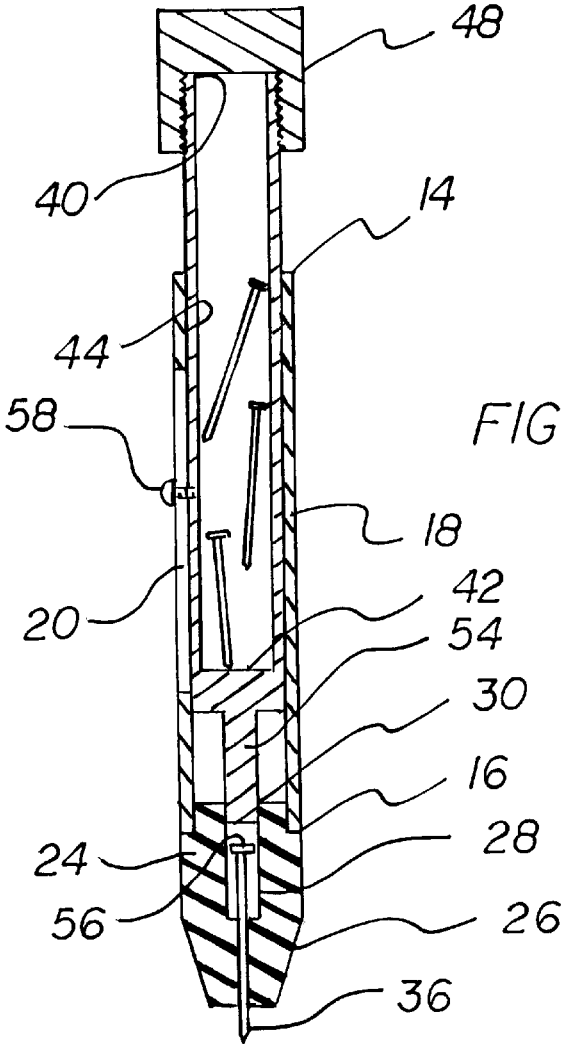
FIG 4

NAIL DRIVING DEVICE WITH DEPTH GUIDE

CROSS REFERENCES AND RELATED SUBJECT MATTER

This application relates to subject matter contained in provisional patent application Ser. No. 60/113,379, filed in the United States Patent & Trademark Office on Dec. 23, 1998.

BACKGROUND OF THE INVENTION

The present invention relates to a nail driving device with depth guide and more particularly pertains to driving nails into wall areas to a predetermined depth.

When driving a nail for hanging a picture is to be driven into the wall, it is necessary to drive the nail into the wall only to a certain depth so that the loop of the picture can be put on the shaft behind the head. When using suspension eyes, which are typical for use when hanging pictures, and the nails have not been driven into the wall far enough, the picture does not abut against the wall properly. To drive a nail adequately far enough with a hammer demands skill and much time, because usually the picture is to be hung for a trial and then the final depth of driving the nail into the wall is to be obtained by additional strikes with the hammer. A nail which has been driven in too far is especially disadvantageous because the normal response would be to pull the nail outwardly thereby creating an insufficient hold.

The present invention seeks to develop a device for driving nails into a wall area, without trial and error, to the correct depth for hanging a picture.

The use of nail driving devices is known in the prior art. More specifically, nail driving devices heretofore devised and utilized for the purpose of driving nails into objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,624,401 to Gassner discloses a device for driving a nail comprised of an elongated housing with a punching member. The Gassner device provides a magazine for feeding the nails. U.S. Pat. No. 4,860,937 to Arnold discloses a nail driving device with a longitudinal cylindrical body and a ram assembly. U.S. Pat. No. 5,520,318 to Sloop discloses a device for hanging pictures on a wall comprised of a drive mechanism mounted on a support frame. U.S. Pat. No. Des. 325,690 to Arnold discloses an ornamental design for a nailing tool.

While these devices fulfill their respective, particular objective and requirements, the aforementioned patents do not describe a nail driving device with depth guide for driving nails into wall areas to a predetermined depth.

In this respect, the nail driving device with depth guide according to the present invention substantially departs from the conventional concepts and designs of the prior art, and in doing so provides an apparatus primarily developed for the purpose of driving nails into wall areas to a predetermined depth.

Therefore, it can be appreciated that there exists a continuing need for new and improved nail driving device with depth guide which can be used for driving nails into wall areas to a predetermined depth. In this regard, the present invention substantially fulfills this need.

SUMMARY OF THE INVENTION

In the view of the foregoing disadvantages inherent in the known types of nail driving devices now present in the prior art, the present invention provides an improved nail driving device with depth guide. As such, the general purpose of the present invention, which will be described subsequently in greater detail, is to provide a new and improved nail driving device with depth guide and method which has all the advantages of the prior art and none of the disadvantages.

To attain this, the present invention essentially comprises an outer cylindrical tube having an open upper end, an open lower end, and a cylindrical side wall therebetween. The cylindrical side wall has an elongated longitudinal slot therethrough. The slot has an upper end disposed downwardly of the open upper end and a lower end disposed upwardly of the open lower end. A tip portion is secured within the open lower end of the outer cylindrical tube. The tip portion has a cylindrical upper portion and a tapered lower portion. The tip portion has a longitudinal central channel therethrough. The central channel has an open upper end in communication with a hollow interior of the outer cylindrical tube. The cylindrical upper portion has an opening through a side wall thereof in communication with the central channel. The tapered lower portion has a longitudinal slit through a side wall thereof. The slit is in communication with the central channel. The central channel receives a nail therein. An inner cylindrical tube is slidably received within the open upper end of the outer cylindrical tube. The inner cylindrical tube has an open upper end, a closed lower end, and a cylindrical side wall therebetween. The cylindrical side wall of the inner tube has measurement markings disposed thereon downwardly of the open upper end thereof. The open upper end has a knurled cap removably coupled thereto. The cap has a diameter greater than a diameter of the inner tube to provide a striking surface for a hammer. A plunger portion is secured to the closed lower end of the inner cylindrical tube. The plunger portion has a generally T-shaped cross-section. The plunger portion includes a stem portion dimensioned for being received within the open upper end of the channel for contacting a head of a nail positioned therein. A retaining member extends through the elongated longitudinal slot of the outer cylindrical tube for engaging the inner cylindrical tube at a predetermined setting in accordance with the measurement markings.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved nail driving device with depth guide which has all the advantages of the prior art nail driving devices and none of the disadvantages.

It is another object of the present invention to provide a new and improved nail driving device with depth guide which may be easily and efficiently manufactured and marketed.

It is a further object of the present invention to provide a new and improved nail driving device with depth guide which is of durable and reliable construction.

An even further object of the present invention is to provide a new and improved nail driving device with depth guide which is susceptible of a low cost of manufacture with regard to both materials and labor, and which accordingly is then susceptible of low prices of sale to the consuming public, thereby making such a nail driving device with depth guide economically available to the buying public.

Even still another object of the present invention is to provide a new and improved nail driving device with depth guide for driving nails into wall areas to a predetermined depth.

Lastly, it is an object of the present invention to provide a new and improved nail driving device with depth guide including an outer cylindrical tube. A tip portion is secured within an open lower end of the outer cylindrical tube. The tip portion has a longitudinal central channel therethrough. The central channel has an open upper end in communication with a hollow interior of the outer cylindrical tube. The central channel receives a nail therein. An inner cylindrical tube is slidably received within the open upper end of the outer cylindrical tube. The inner tube has measurement markings disposed thereon. A plunger portion is secured to s closed lower end of the inner cylindrical tube. The plunger portion includes a stem portion dimensioned for being received within the open upper end of the channel for contacting a head of a nail positioned therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of the preferred embodiment of the nail driving device with depth guide constructed in accordance with the principles of the present invention.

FIG. 2 is a perspective view of the present invention.

FIG. 3 is a front view of the present invention as taken along line 3—3 of FIG. 2.

FIG. 4 is a cross-sectional view of the present invention as taken along line 4—4 of FIG. 3.

The same reference numerals refer to the same parts through the various figures.

DESCRIPTION OF THE PREFERRED EMBODIMENT

With reference now to the drawings, and in particular, to FIGS. 1 through 4 thereof, the preferred embodiment of the new and improved nail driving device with depth guide embodying the principles and concepts of the present invention and generally designated by the reference number 10 will be described.

Specifically, it will be noted in the various Figures that the device relates to a nail driving device with depth guide for driving nails into wall areas to a predetermined depth. In its broadest context, the device consists of an outer cylindrical tube, a tip portion, an inner cylindrical tube, a plunger portion, and a retaining member. Such components are individually configured and correlated with respect to each other so as to attain the desired objective.

The outer cylindrical tube 12 has an open upper end 14, an open lower end 16, and a cylindrical side wall 18 therebetween. The cylindrical side wall 18 has an elongated longitudinal slot 20 therethrough. The slot 20 has an upper end disposed downwardly of the open upper end 14 and a lower end disposed upwardly of the open lower end 16. The outer tube is preferably constructed of a heavy metal to tolerate continuous use.

The tip portion 22 is secured within the open lower end 16 of the outer cylindrical tube 12. The tip portion 22 has a cylindrical upper portion 24 and a tapered lower portion 26. The tip portion 26 has a longitudinal central channel 28 therethrough. The central channel 28 has an open upper end 30 in communication with a hollow interior of the outer cylindrical tube 12. The cylindrical upper portion 24 has an opening 32 through a side wall thereof in communication with the central channel 28. The tapered lower portion 26 has a longitudinal slit 34 through a side wall thereof. The slit 34 is in communication with the central channel 28. The central channel 28 receives a nail 36 therein. The head of the nail 36 is received within the central channel 28 through the opening 32 whereby the stem of the nail 36 is received through the slit 34. The tip portion 22 is preferably fabricated of a rubber material whereby relative expansion is permitted for the receiving and dispensing of nails.

The inner cylindrical tube 38 is slidably received within the open upper end 14 of the outer cylindrical tube 12. The inner cylindrical tube 38 has an open upper end 40, a closed lower end 42, and a cylindrical side wall 44 therebetween. The cylindrical side wall 44 of the inner tube 38 has measurement markings 46 disposed thereon downwardly of the open upper end 40 thereof. The open upper end 40 has a knurled cap 48 removably coupled thereto. The cap 48 has a diameter greater than a diameter of the inner tube 38 to provide a striking surface for a hammer 50. The inner tube 38 can be used to hold a plurality of nails within an interior thereof. Note FIG. 4. The nails can be retrieved simply by removing the cap 48.

The plunger portion 52 is secured to the closed lower end 42 of the inner cylindrical tube 38. The plunger portion 52 has a generally T-shaped cross-section. The plunger portion 52 includes a stem portion 54 dimensioned for being received within the open upper end 30 of the channel 28 for contacting a head 56 of a nail 36 positioned therein. Thus, when the hammer 50 strikes the cap 48, the force will cause the plunger portion 52 to contact the nail 36 thereby driving the nail into a recipient surface. Note FIG. 1.

The retaining member 58 extends through the elongated longitudinal slot 20 of the outer cylindrical tube 12 for engaging the inner cylindrical tube 38 at a predetermined setting in accordance with the measurement markings 46. In use, a user of the device 10 would determine the depth they want the nail to extend within the recipient surface and the subsequent amount the nail protrudes outwardly of said recipient surface. The user would then align the appropriate measurement marking 56 with the open upper end 14 of the outer tube 12 to accomplish the desired placement of the nail 36. The retaining member 58 is then tightened to frictionally engage the inner tube 38 whereby slight movement of the device 10 would not facilitate slight movement of the inner tube 38 with respect to the outer tube 12. The tip portion 22 is then placed against the recipient surface, and the cap 48 is struck by the hammer 50 to properly drive the nail 36 to the desired depth. The tip portion 22, being resilient because of it's rubber fabrication, can expand to separate from the driven nail.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A nail driving device with depth guide for driving nails into wall areas to a predetermined depth comprising, in combination:

an outer cylindrical tube having an open upper end, an open lower end, and a cylindrical side wall therebetween, the cylindrical side wall having an elongated longitudinal slot therethrough, the slot having an upper end disposed downwardly of the open upper end and a lower end disposed upwardly of the open lower end;

a tip portion secured within the open lower end of the outer cylindrical tube, the tip portion having a cylindrical upper portion and a tapered lower portion, the tip portion having a longitudinal central channel therethrough, the central channel having an open upper end in communication with a hollow interior of the outer cylindrical tube, the cylindrical upper portion having an opening through a side wall thereof in communication with the central channel, the tapered lower portion having a longitudinal slit through a side wall thereof, the slit being in communication with the central channel, the central channel receiving a nail therein;

an inner cylindrical tube slidably received within the open upper end of the outer cylindrical tube, the inner cylindrical tube having an open upper end, a closed lower end, and a cylindrical side wall therebetween defining an interior, the cylindrical side wall of the inner tube having measurement markings disposed thereon downwardly of the open upper end thereof, the open upper end having a cap removably coupled thereto such that a plurality of nails can be held within the interior of the inner tube, the cap having a diameter greater than a diameter of the inner tube to provide a striking surface for a hammer;

a plunger portion secured to the closed lower end of the inner cylindrical tube, the plunger portion having a generally T-shaped cross-section, the plunger portion including a stem portion dimensioned for being received within the open upper end of the channel for contacting a head of a nail positioned therein; and a retaining member extending through the elongated longitudinal slot of the outer cylindrical tube for engaging the inner cylindrical tube at a predetermined setting in accordance with the measurement markings.

2. A nail driving device with depth guide for driving nails into wall areas to a predetermined depth comprising, in combination:

an outer cylindrical tube;

a tip portion secured within an open lower end of the outer cylindrical tube, the tip portion having a longitudinal central channel therethrough, the central channel having an open upper end in communication with a hollow interior of the outer cylindrical tube, the central channel receiving a nail therein;

an inner cylindrical tube slidably received within an open upper end of the outer cylindrical tube, the inner tube having measurement markings disposed thereon, the inner tube having a closed lower end, an open upper end, and a cylindrical wall extending therebetween defining an interior for allowing a plurality of nails to be held therein, and a cap removably coupled with the upper end; and a plunger portion secured to a lower end of the inner cylindrical tube, the plunger portion including a stem portion dimensioned for being received within the open upper end of the channel for contacting a head of a nail positioned therein.

3. The nail driving device with depth guide as set forth in claim 2 wherein the tip portion has a cylindrical upper portion and a tapered lower portion, the cylindrical upper portion having an opening through a side wall thereof in communication with the central channel, the tapered lower portion having a longitudinal slit through a side wall thereof, the slit being in communication with the central channel.

4. The nail driving device with depth guide as set forth in claim 2 wherein the inner cylindrical tube having an open upper end, the open upper end having a knurled cap removably coupled thereto.

5. The nail driving device with depth guide as set forth in claim 4 wherein the cap has a diameter greater than a diameter of the inner tube to provide a striking surface for a hammer.

6. The nail driving device with depth guide as set forth in claim 2 wherein the plunger portion has a generally T-shaped cross-section.

7. The nail driving device with depth guide as set forth in claim 2 and further including a retaining member extending through an elongated longitudinal slot of the outer cylindrical tube for engaging the inner cylindrical tube at a predetermined setting in accordance with the measurement markings.

* * * * *